US010583066B1

(12) United States Patent
Abroms

(10) Patent No.: US 10,583,066 B1
(45) Date of Patent: Mar. 10, 2020

(54) VERTICALLY AND HORIZONTALLY ADJUSTABLE WALKER

(71) Applicant: Susan Abroms, Florence, AL (US)

(72) Inventor: Susan Abroms, Florence, AL (US)

( * ) Notice: Subject to any disclaimer, the term of this patent is extended or adjusted under 35 U.S.C. 154(b) by 0 days.

(21) Appl. No.: 16/291,433

(22) Filed: Mar. 4, 2019

(51) Int. Cl.
*A61H 3/04* (2006.01)
*B25G 1/04* (2006.01)
*A45B 9/00* (2006.01)

(52) U.S. Cl.
CPC ..... *A61H 3/04* (2013.01); *B25G 1/04* (2013.01); *A45B 2009/007* (2013.01); *A61H 2201/0192* (2013.01); *A61H 2201/1638* (2013.01); *A61H 2203/0406* (2013.01)

(58) Field of Classification Search
CPC ... A61H 3/04; A61H 3/008; A61H 2201/0192
See application file for complete search history.

(56) References Cited

U.S. PATENT DOCUMENTS 2,556,121 A * 6/1951 Thomas ..... A61G 5/10 280/304.1
2,634,790 A * 4/1953 Elle ..... A61H 3/00 135/67
2,667,914 A * 2/1954 Forbes ..... A61H 3/04 482/67
2,732,004 A * 1/1956 Forbes ..... A61H 3/04 482/67
3,273,888 A * 9/1966 Burns ..... A61H 3/04 482/67
3,778,052 A * 12/1973 Andow ..... A61H 3/008 280/87.041
4,941,497 A 7/1990 Prather et al.
5,526,893 A * 6/1996 Higer ..... A61H 3/04 180/65.1
6,527,285 B1 3/2003 Calandro, II
6,578,594 B1 6/2003 Bowen et al.
6,733,018 B2 5/2004 Razon
8,151,812 B2 4/2012 Razon
8,720,914 B1 5/2014 Heath et al.
8,936,033 B2 * 1/2015 Velarde ..... A61H 3/00 135/67

(Continued)

OTHER PUBLICATIONS

Wenzelite, Anterior Safety Roller brochure, 2 pgs; Wenzelite Product Catalog; 2014.

*Primary Examiner* — Noah Chandler Hawk
(74) *Attorney, Agent, or Firm* — Lanier Ford Shaver & Payne, PC; Gerald M. Walsh

(57) ABSTRACT

An adjustable walker having a horizontal base and a horizontal upper support frame, each being adjustable in width. A pair of vertical support frames are attached to the horizontal base frame and are adjustably attached to the horizontal upper support frame so that the horizontal upper support frame is adjustable in height. Extensions on the rear ends of the horizontal base frame and the horizontal upper support frame extend beyond the rear end of the walker. Pivotable caster wheels are attached to the front end of the horizontal base frame. Non-pivoting rear wheels are attached to the rear end of the horizontal base frame to stabilize the rear end. The horizontal upper support frame supports the upper body of a user. The extensions provide support to the user and stability to the walker as a user exits the rear of the walker to sit on a bed or chair.

16 Claims, 3 Drawing Sheets

(56) References Cited

U.S. PATENT DOCUMENTS

| | | | | |
|---|---|---|---|---|
| 9,278,042 | B2 | 3/2016 | Osterhaus | |
| 9,820,901 | B2 | 11/2017 | Brown et al. | |
| 10,391,018 | B1 * | 8/2019 | Fitzwater | A61H 3/04 |
| 2004/0020525 | A1 * | 2/2004 | Lev | A61H 3/04 135/66 |
| 2005/0183759 | A1 | 8/2005 | Wolfe | |
| 2007/0107761 | A1 | 5/2007 | Kovachi et al. | |
| 2016/0038370 | A1 * | 2/2016 | Dreske | A61H 3/008 482/68 |
| 2018/0250189 | A1 | 9/2018 | Johnson | |

* cited by examiner

VERTICALLY AND HORIZONTALLY ADJUSTABLE WALKER

FIELD OF THE INVENTION

This invention relates generally to physical therapy assistive devices and, more particularly, to walkers that are vertically and horizontally adjustable, provide underarm support, and are open at a rear end with support extensions to facilitate exiting the walker and sitting down on a chair or bed.

BACKGROUND OF THE INVENTION

Patients require rehabilitation for walking as a result of aging, stroke, or other injuries. Such rehabilitation is typically performed under the supervision of a medical professional, and frequently in the context of a medical facility, such as an outpatient clinic or other specialized rehabilitation clinic. Rehabilitation includes the use of walkers that help ease the load from the feet, helping the patient to correct an uneven gait or limp, while the patient simultaneously relearns muscle coordination and builds muscle strength. These known apparatuses, including conventional walkers and wheelchairs, are not entirely satisfactory for the range of applications in which they are employed. U.S. Pat. No. 9,278,042 discloses a walker that is vertically and horizontally adjustable. The walker has four caster wheels which each pivot 360 degrees. The entire walker pivots easily and requires that a user remain confined within the walker on all four sides of the walker. Although the confinement provides safety for the user it makes the walker impractical for one who wishes to use a vertically and horizontally adjustable walker outside the confines of a clinic or hospital. What is needed is a vertically and horizontally adjustable walker that is open in the rear and facilitates entering and leaving the walker from the rear of the walker, while remaining stable with regard to rotation of the walker.

SUMMARY OF THE INVENTION

The present invention is a walker having a horizontal base frame and a horizontal upper support frame, each having a front end and a rear end and each being adjustable in width. The horizontal base frame and the horizontal upper support frame are joined together by a pair of vertical support frames therebetween. The bottom ends of the vertical support frames are fixed to the horizontal base frame and the top ends of the vertical support frame are slidably, adjustably attached to the horizontal upper support frame so that the horizontal upper support frame is adjustable in height. The horizontal upper support frame is constructed to support the underarms of a user and may have support cushions for the arm pits of the user. The horizontal base frame and the horizontal upper support frame are closed at their front ends and open at their rear ends. The open rear ends allow a user to enter and exit the interior of the walker. The horizontal base frame and the horizontal upper support frame have extensions on the rear ends. The extensions extend beyond and away from the rear ends of the vertical support frames. The extensions can be gripped by a user as the user exits the rear of the walker, providing support for the user as the user leaves the walker to sit on a chair or bed.

Caster wheels are attached to the front end of the horizontal base frame. The caster wheels are pivotable 360 degrees. Rear wheels attached to the rear end of the horizontal base frame are non-pivotable, remaining in alignment with the longitudinal axis of the horizontal base frame. The rear wheels may have brakes. The vertical support frames have horizontal support bars. Arm supports and brake handles may be attached to the horizontal support bars. A sling to support the user may be positioned in the interior of the walker with support straps attached to the horizontal upper support frame. The sling may include a seat member.

An advantage of the walker of the present invention is the ability to easily adjust the height and width of the walker.

Another advantage is a horizontal upper support frame that supports the upper body of a user.

Another advantage are extensions at the rear of the walker that provide support to the user and stability to the walker as a user exits the rear of the walker.

Another advantage are caster wheels at the front of the walker that pivot 360 degrees, making the walker easy to steer.

Another advantage are rear wheels that do not pivot so the rear end of the walker remains stable as a user moves the walker forward and backward and exits the rear of the walker.

DETAILED DESCRIPTION OF THE INVENTION

While the following description details the preferred embodiments of the present invention, it is to be understood that the invention is not limited in its application to the details of arrangement of the parts described herein and illustrated in the accompanying figures, since the invention is capable of other embodiments and of being practiced in various ways.

Figure 1:
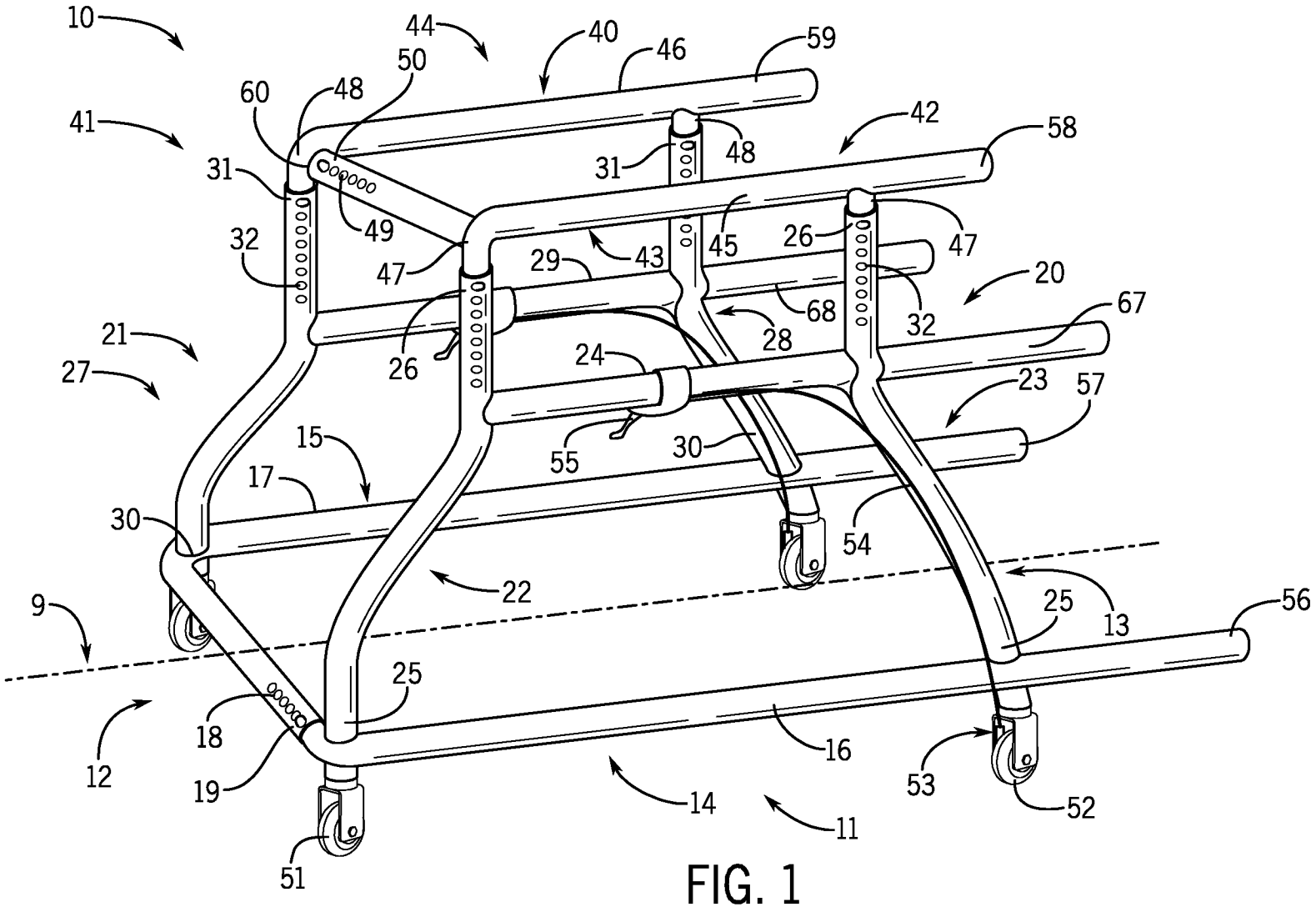
FIG. 1 is a front, top, and side perspective view of the walker of the present invention.

FIG. 1 is a front, top, and side perspective view of the walker 10 of the present invention. Walker 10 has a horizontal tubular base frame 11 having a front end 12, a rear end 13, a first side 14, and a second opposite side 15. The horizontal base frame 11 is constructed of a first portion 16 and a second portion 17. The front end 12 of the first portion 16 fits telescopically into an open end 19 at a front end 12 of the second portion 17. The second portion 17 has a plurality of adjustment openings 18 along a portion of its length near the open end 19. The tip of the first portion 16 that is telescopically and slideably insertable into opening 19 is locked into place, preferably, with a quick release ball lock pin (not shown) which protrudes into one of the selected adjustment openings 18 to maintain a desired width of the front end 12 of the horizontal base frame 11, by methods well known in the art (for example, see U.S. Pat. No. 9,278,042). In this manner, the width of the horizontal base frame 11 can be adjusted as desired by moving the first portion 16 into or out of the second portion 17 a desired length to adjust the width of the horizontal base frame 11 as desired, by methods well known in the art. The quick release ball lock pin is inserted into the desired adjustment opening 18 to lock the first portion 16 into place. The front end 12 of the horizontal base frame 11 is closed and the rear end 13 of the horizontal base frame 11 is open.

The walker 10 has a first vertical tubular support frame 20 and a second vertical support frame 21. The first vertical support frame 20 has a front end 22, a rear end 23, a horizontal support member 24 between the front end 22 and the rear end 23, bottom ends 25 and open top ends 26. The second vertical support frame 21 has a front end 27, a rear end 28, a horizontal support member 29 between the front end 27 and the rear end 28, bottom ends 30 and open top ends 31. The bottom ends 25 of the first vertical support frame 20 are attached to the first side 14, first portion 16 of the horizontal base frame 11. The bottom ends 30 of the second vertical support frame 21 are attached to the second side 15, second portion 17 of the horizontal base frame 11. Along the front end 22 and rear end 23 of the first vertical support frame 20 near the top ends 26 are a plurality of adjustment openings 32. Along the front end 27 and rear end 28 of the second vertical support frame 21 near the top ends 31 are a plurality of adjustment openings 32.

The walker 10 has a horizontal tubular upper support frame 40 having a front end 41 and a rear end 42, a first side 43, and a second opposite side 44. The horizontal upper support frame 40 has a first portion 45 and a second portion 46. The front end 41 of the first portion 45 has an open end 50 and a plurality of adjustment openings 49 along its length near open end 50. The first portion 45 has vertical legs 47 which extend telescopically and slideably into open top ends 26 of the first vertical support frame 20. The second portion 46 has vertical legs 48 which extend telescopically and slideably into open top ends 31 of the second vertical support frame 21. The second portion 46 also has a horizontal leg 60 that extends telescopically and slideably into the open end 50 at the front end 41 of the first portion 45. The vertical legs 47 and 48 each receive a quick release ball lock pin (not shown) which protrudes into a selected adjustment opening 32 to maintain a desired height of the walker 10, as described for the quick release ball lock pin in the horizontal base frame 11. Likewise, the horizontal leg 60 receives a quick release ball lock pin (not shown) which protrudes into a selected adjustment opening 49 to maintain a desired width of walker 10. The front end 41 of the horizontal upper support frame 40 is closed and the rear end 42 of the horizontal upper support frame 40 is open.

The horizontal base frame 11 and the horizontal upper support frame 40 are adjustable in width by use of the quick release ball lock pins and adjustment holes 18 and 49 so the overall width of walker 10 is adjustable. The horizontal support frame 40 is adjustable in height by use of the quick release ball lock pins and the adjustment holes 32 in the vertical support frames 20 and 21 so that the overall height of the walker 10 is adjustable. Thus, walker 10 can accommodate any size user.

Walker 10 has front wheels 51 on the front end 12 of the horizontal base frame 11 which are, preferably, caster wheels that pivot 360 degrees and rear wheels 52 on the rear end 13 of the horizontal base frame 11 which are not caster wheels. The rear wheels 52 do not pivot and remain in alignment with the longitudinal axis 9 of the horizontal base frame 11. This arrangement of the wheels allows the front end 12 to rotate freely but keeps the rear end 13 stable. The rear wheels 52 have brake mechanisms 53 which have cables 54 connected to brake handles 55 mounted to the horizontal supports 24 and 29. The brake handles 55 and brakes 53 operate by methods well known in the art.

The sides 14 and 15 of the horizontal base frame 11 have rear extensions 56 and 57 which extend beyond the rear end 13 of the horizontal base frame 11 away from the rear ends 23 and 28 of the first vertical support frame 20 and the second vertical support frame 21. The sides 43 and 44 of the horizontal upper support frame 40 have rear extensions 58 and 59 that extend beyond the rear end 42 of the horizontal upper support frame 40 away from the rear ends 23 and 28 of the first vertical support frame 20 and the second vertical support frame 21. The horizontal support members 24 and 29 of the vertical support frames 20 and 21 also have rear extensions 67 and 68. The extensions allow a user to exit the rear end of the walker 10 while holding on to the extensions 67 and 68 for support and while extensions 56 and 57 slip under a chair or bed. For example, a user may back the walker up to a bed, chair, or toilet and sit down while still grasping the extensions 67 and 68 for support. A user may also grasp the extensions 67 and 68 from a sitting position to assist in standing up while the upper extensions 58 and 59 slide under the arms of the user.

Figure 2:
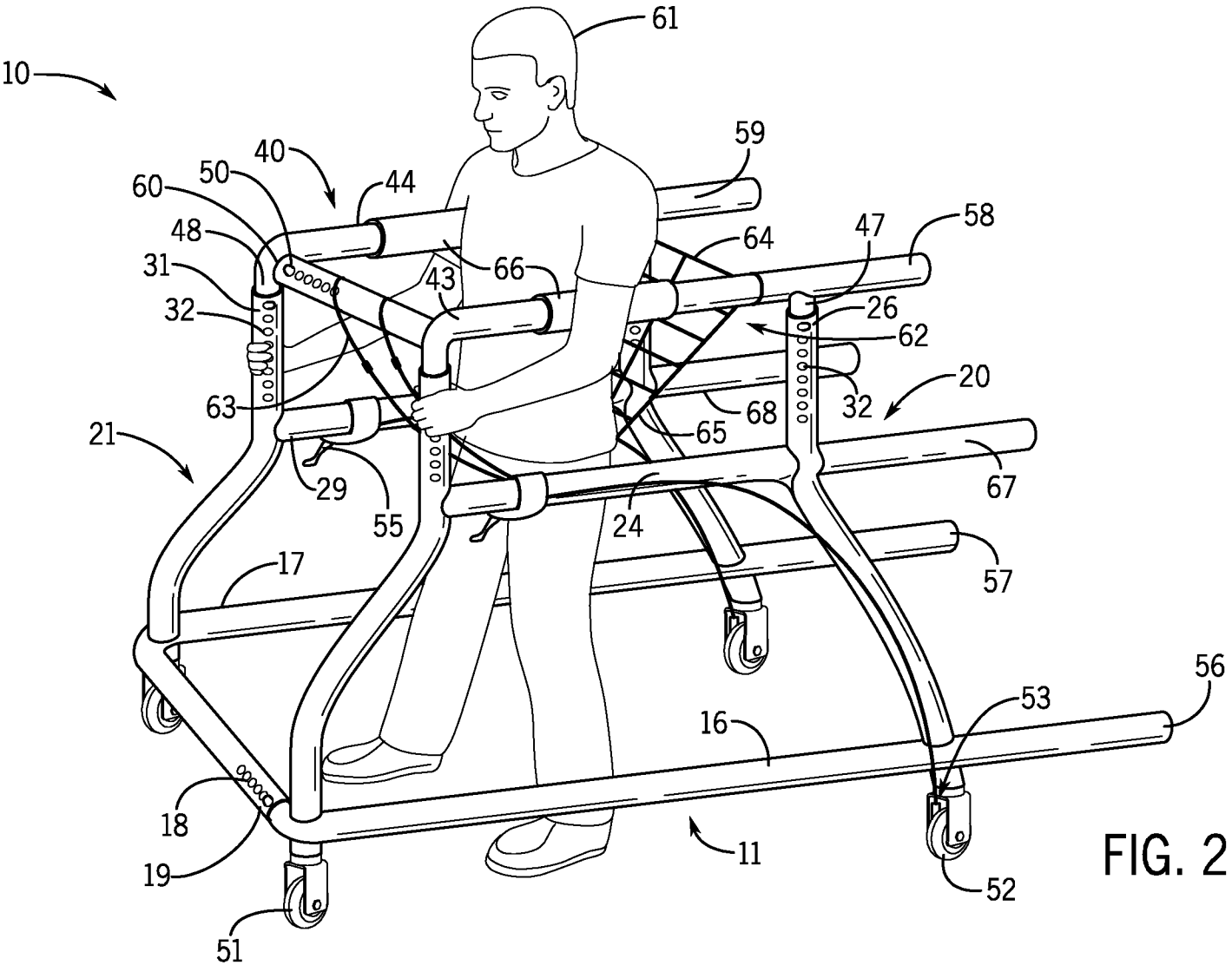
FIG. 2 shows the walker of FIG. 1 with a user inside the walker and a harness system attached to the walker and supporting the user.

FIG. 2 shows the walker 10 with a user 61 inside the walker 10 and a harness system 62 attached to the walker 10 and supporting the user 61. The harness 62 has front straps 63, rear straps 64, and a single strap 65 between the legs of the user 61 for fall prevention. The harness 62 is suspended from the horizontal upper support frame 40. The first side 43 and the second opposite side 44 of the horizontal upper support frame 40 each have an under-arm support cushion 66. The under-arm support cushions 66 allow a user to comfortably place some or all of his or her weight on the sides 43 and 44 as needed. The rear extensions 67 and 68, preferably, may have rubberized grips for comfort.

Figure 3:
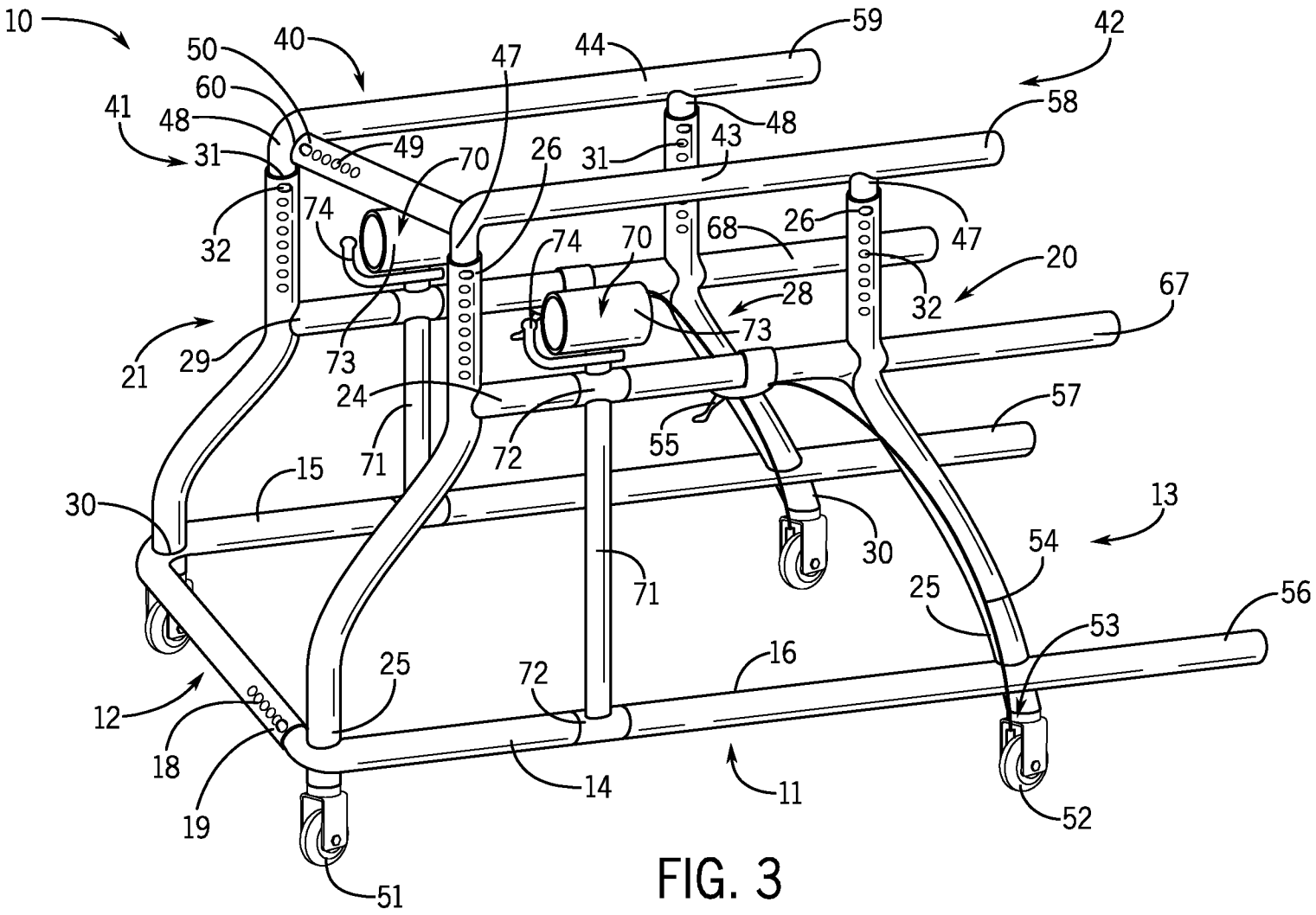
FIG. 3 shows the walker of FIG. 1 with arm rests reversibly attached to the sides of the walker.

FIG. 3 shows the walker 10 with arm rests 70 reversibly attached to the horizontal supports 24 and 29 of the first vertical support frame 20 and the second vertical support frame 21 and to the first side 14 and second opposite side 15 of the horizontal base frame 11. The arm rest 70 has a support pole 71 with a cushion 73 and handle grip 74 at a top end. The arm rest 70 allows a user to support some of his or her weight on the cushions 73 using, for example, the forearms.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the walker can be constructed with any suitable type of metal or plastic. Any type of adjusting means may be used in place of the telescoping tubing, adjustment openings, and quick release ball lock pins, such as, for example, spring bias pins, twisting pressure collars, interchangeable fixed length members, or bars sliding within channels.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A walker, comprising:

a) a horizontal base frame having a front end and a rear end and being adjustable in width;

b) a horizontal upper support frame having a front end and a rear end and being adjustable in width;

c) a pair of vertical support frames, each having a front end and a rear end, attached to the horizontal base frame and slidably, adjustably attached to the horizontal upper support frame so that the horizontal upper support frame is adjustable in height;

d) the horizontal base frame and the horizontal upper support frame being closed at their front ends and open at their rear ends;

e) extensions on the rear ends of the horizontal base frame and the horizontal upper support frame, said extensions extending beyond and away from the rear ends of the vertical support frames;

f) caster wheels attached to the front end of the horizontal base frame, the caster wheels being pivotable 360 degrees; and g) rear wheels attached to the rear end of the horizontal base frame which are non-pivotable and remain in alignment with the longitudinal axis of the horizontal base frame.

2. The walker of claim 1, further comprising the horizontal upper support frame constructed to support the underarms of a user.

3. The walker of claim 2, further comprising support cushions on the horizontal upper support frame constructed for the underarms of the user.

4. The walker of claim 1, further comprising the vertical support frames having horizontal support bars.

5. The walker of claim 4, further comprising arm supports attached to the horizontal support bars, constructed to support the forearms of a user.

6. The walker of claim 4, further comprising brake handles attached to the horizontal support bars.

7. The walker of claim 1, further comprising the rear wheels having brakes.

8. The walker of claim 1, further comprising a sling with support straps and seat attached to the horizontal upper support frame.

9. A walker, comprising:

a) a horizontal base frame having a front end and a rear end and being adjustable in width;

b) a horizontal upper support frame having a front end and a rear end and being adjustable in width;

c) a pair of vertical support frames, each having a front end and a rear end, attached to the horizontal base frame and slidably, adjustably attached to the horizontal upper support frame so that the horizontal upper support frame is adjustable in height;

d) the horizontal base frame and the horizontal upper support frame being closed at their front ends and open at their rear ends;

e) extensions on the rear ends of the horizontal base frame and the horizontal upper support frame, said extensions extending beyond and away from the rear ends of the vertical support frames;

f) caster wheels attached to the front end of the horizontal base frame, the caster wheels being pivotable 360 degrees;

g) rear wheels attached to the rear end of the horizontal base frame which are non-pivotable and remain in alignment with the longitudinal axis of the horizontal base frame; and h) the horizontal upper support frame constructed to support the underarms of a user, the horizontal upper support frame having support cushions constructed for the underarms of the user.

10. The walker of claim 9, further comprising the vertical support frames having horizontal support bars.

11. The walker of claim 10, further comprising arm supports attached to the horizontal support bars, constructed to support the forearms of the user.

12. The walker of claim 10, further comprising brake handles attached to the horizontal support bars.

13. The walker of claim 9, further comprising the rear wheels having brakes.

14. The walker of claim 9, further comprising a sling with support straps and seat attached to the horizontal upper support frame.

15. A walker, comprising:

a) a horizontal base frame having a front end and a rear end and being adjustable in width;

b) a horizontal upper support frame having a front end and a rear end and being adjustable in width;

c) a pair of vertical support frames, each having a front end and a rear end, attached to the horizontal base frame and slidably, adjustably attached to the horizontal upper support frame so that the horizontal upper support frame is adjustable in height, the vertical support frames having horizontal support bars;

d) the horizontal base frame and the horizontal upper support frame being closed at their front ends and open at their rear ends;

e) extensions on the rear ends of the horizontal base frame and the horizontal upper support frame, said extensions extending beyond and away from the rear ends of the vertical support frames;

f) caster wheels attached to the front end of the horizontal base frame, the caster wheels being pivotable 360 degrees;

g) rear wheels attached to the rear end of the horizontal base frame which are non-pivotable and remain in alignment with the longitudinal axis of the horizontal base frame, the rear wheels having brakes;

h) the horizontal upper support frame constructed to support the underarms of a user, the horizontal upper support frame having support cushions constructed for the underarms of the user; and i) arm supports, constructed to support the forearms of the user, and brake handles attached to the horizontal support bars.

16. The walker of claim 15, further comprising a sling with support straps and seat attached to the horizontal upper support frame.

* * * * *